United States Patent [19]

Suttles

[11] Patent Number: 4,535,704

[45] Date of Patent: Aug. 20, 1985

[54] SYSTEM OF SHELVING

[75] Inventor: James M. Suttles, Elberton, Ga.

[73] Assignee: The Mead Corporation, Atlanta, Ga.

[21] Appl. No.: 529,397

[22] Filed: Sep. 6, 1983

[51] Int. Cl.[3] ..... A47B 96/12

[52] U.S. Cl. ..... 108/108; 108/152; 211/128; 248/243

[58] Field of Search ..... 108/107, 108, 152; 248/243, 242, 239; 211/128

[56] References Cited

U.S. PATENT DOCUMENTS

| | | | |
|---|---|---|---|
| 3,089,675 | 5/1963 | Lozier | 248/242 |
| 3,729,161 | 4/1973 | Christensen | 248/242 |
| 4,008,873 | 2/1977 | Travaglio | 248/242 |
| 4,307,671 | 12/1981 | Albano | 248/242 |
| 4,460,097 | 7/1984 | Darnell, II et al. | 211/128 |

*Primary Examiner*—James T. McCall

*Attorney, Agent, or Firm*—Howson and Howson

[57] ABSTRACT

In a shelving unit having a two-piece upright with a sloping slotted lower part and a vertical slotted upper part telescoping into the lower part, the slots in the upper part are recessed behind the upper end of the slotted portion of the lower part to allow room for shelf tabs projecting through the slots in the lower part near the upper end thereof. A shelf bracket may be mounted at the transition between the lower and upper parts of the support with its upper tab in a slot in the upper part and with one or more of its lower tabs projecting through slots in the lower part. The slots of the two parts are positioned relative to each other so that the lower tabs project through their slots in the lower part of the support and abut the recessed slotted surface of the upper part, which extends downwardly behind the slotted surface of the lower part. In this way a shelf spanning the transition is situated at the same angle as a shelf supported entirely on the upper part. The shelf tabs are also designed with steps, and the slots of the sloping face of the lower part are spaced farther apart from each other than the slots of the vertical face of the upper part. Thus a shelf supported entirely on the lower part also assumes the same angle as shelves on the upper part or at the transition.

8 Claims, 4 Drawing Figures

SYSTEM OF SHELVING

BRIEF SUMMARY OF THE INVENTION

This invention relates to shelving systems of the kind used in supermarkets to display soft drinks and various other products. This invention is applicable to a variety of shelving systems, and is particularly applicable to a shelving system of the kind shown and described in my U.S. Pat. No. 3,983,822, issued Oct. 5, 1976. Depending on the use to which they are put, these shelving units are sometimes called "merchandisers".

In U.S. Pat. No. 3,983,822, I described a sheet metal shelving system in which identical shelves are held on uprights by the engagement of tabs on shelf brackets with slots in the uprights. Each upright has an upper and lower part. The lower part has a sloping face, while the upper part has a vertical face. The upper part telescopes into the lower part and the two parts are secured together by a suitable fastener. There is no provision for adjusting the height of the upper part relative to the lower part.

In the shelving unit of U.S. Pat. No. 3,983,822, a series of shelf-supporting slots extends substantially the full height of the face of the sloping part of each upright. Another series of slots extends substantially the full vertical length of the exposed portion of the upper part. Thus, shelves can be positioned at any desired location on either part of the uprights. The shelving system described in my patent has the advantage over prior shelving systems that it accommodates identical shelves at any desired height, whether on the sloping faces of the lower parts of the uprights or on the vertical faces of the upper parts of the uprights.

When a shelf is positioned on the lower parts of the uprights, the tabs of the shelf brackets extend rearwardly through the slots in the lower parts. In practice, the lower ends of the upper parts, which are hidden within the lower parts, are provided with vertically elongated slots, or are cut away, to prevent inteference between the upper parts and any shelf bracket tabs extending rearwardly through slots at the upper ends of the lower parts.

It is not possible to reduce the height of the shelving unit by sliding the upper parts downwardly into the lower parts, and still support shelves at or near the upper ends of the lower parts. This is because the slotted faces of the upper parts would interfere with the shelf bracket tabs extending through the slots in the lower parts. This problem of interference is addressed in my pending application Ser. No. 415,483, filed Sept. 7, 1982.

In accordance with said application, interference between the tabs of a shelf bracket mounted near the upper end of a lower part and the upper part which telescopes into the lower part is avoided by forming the slots of the upper part in a rearwardly offset surface. By doing this, a clearance is provided for tabs extending through slots at or near the uppermost end of the lower part of the support.

In the system described in my patent, it is possible to mount a shelf bracket near the upper end of the lower part of a two-part shelf support, but the upper part of the shelf support cannot be telescoped into the lower part for height adjustment. In the system of my pending application, the offset surface of the upper part provides a clearance for the tabs of a shelf bracket mounted near the upper end of the lower part. Thus, vertical telescoping adjustment of the height of the upper part can take place. In the system of my patent, it is possible to mount a shelf bracket so that it spans the transition between the sloping lower part and the vertical upper part of a support, with its upper tab in a slot in the upper part, and with one or more of its lower tabs in slots in the lower support. A shelf mounted in this manner is nearly, but not perfectly horizontal. However, it is at least possible to mount a shelf in this manner, provided that the upper and lower parts of the support are related to each other in such a way that one or more of the lower tabs of the shelf bracket are able to enter the slots in the lower part of the support.

With the telescoping system of my pending application, any attempt to mount a shelf bracket so that it spans the transition between the vertical upper part and the sloping lower part of a support would be completely unsuccessful. The recessed surface of the upper part of the support is so far behind the slotted surface of the sloping lower part that a shelf so mounted would have a considerable rearward slope. Furthermore, the lower tabs of the bracket would not properly engage the slots of the lower part of the support.

The present invention overcomes this problem, and provides for the mounting of the same shelf on the vertical upper part of a support, on the sloping lower part of a support, or spanning the transition, with the shelf surface either always horizontal, or always at the same predetermined angle.

The shelving system in accordance with the invention has a slotted sloping lower support, and a slotted vertical upper support which telescopes into the lower support. The slotted surface of the upper support may be, and desirably is, recessed to allow shelving to be mounted near the upper end of the lower support. The slots of the lower support are spaced farther apart than the slots of the upper support in the manner described in my U.S. Pat. No. 3,983,822, so that, when shelves are installed, they automatically assume horizontal positions. When a shelf is installed across the transition between the sloping lower part and the vertical upper part of a support, its upper tab is engaged in the slot in the vertical upper part, and its lower tabs all engage the face of the upper part at locations between the slots of the upper part. Those tabs which are located below the upper end of the lower part extend through the slots of the lower part to engage the face of the upper part. The proper relationship between the lower tabs of a bracket and the slots of the lower part of the support is accomplished by accurately locking the upper and lower parts together in a predetermined telescoping relationship to each other. Locking pins and slots are used to provide for two or more such particular relationships. The tabs of the shelf brackets are longer than the tabs of the brackets described in my patent and in my application, so that they are able to extend through the slots in the sloping lower part of the shelf support and reach the recessed face of the upper part of the support located behind the slotted sloping element of the lower part.

The principal object of this invention is to provide a simple and effective means for mounting shelf brackets across a transition between sloping and vertical parts of a support, while maintaining the shelf surface horizontal (or at any other predetermined desired angle), thus providing for a more versatile shelving system and making better use of available storage space.

Other objects will be apparent from the following detailed description when read in conjunction with the drawings.

DETAILED DESCRIPTION

A shelving unit in accordance with the invention comprises a pair of uprights and at least one shelf, the shelf having two brackets, each having tabs for engaging slots in the uprights. The uprights are held in fixed relationship to each other by suitable structure to provide a free-standing unit.

Figure 1:
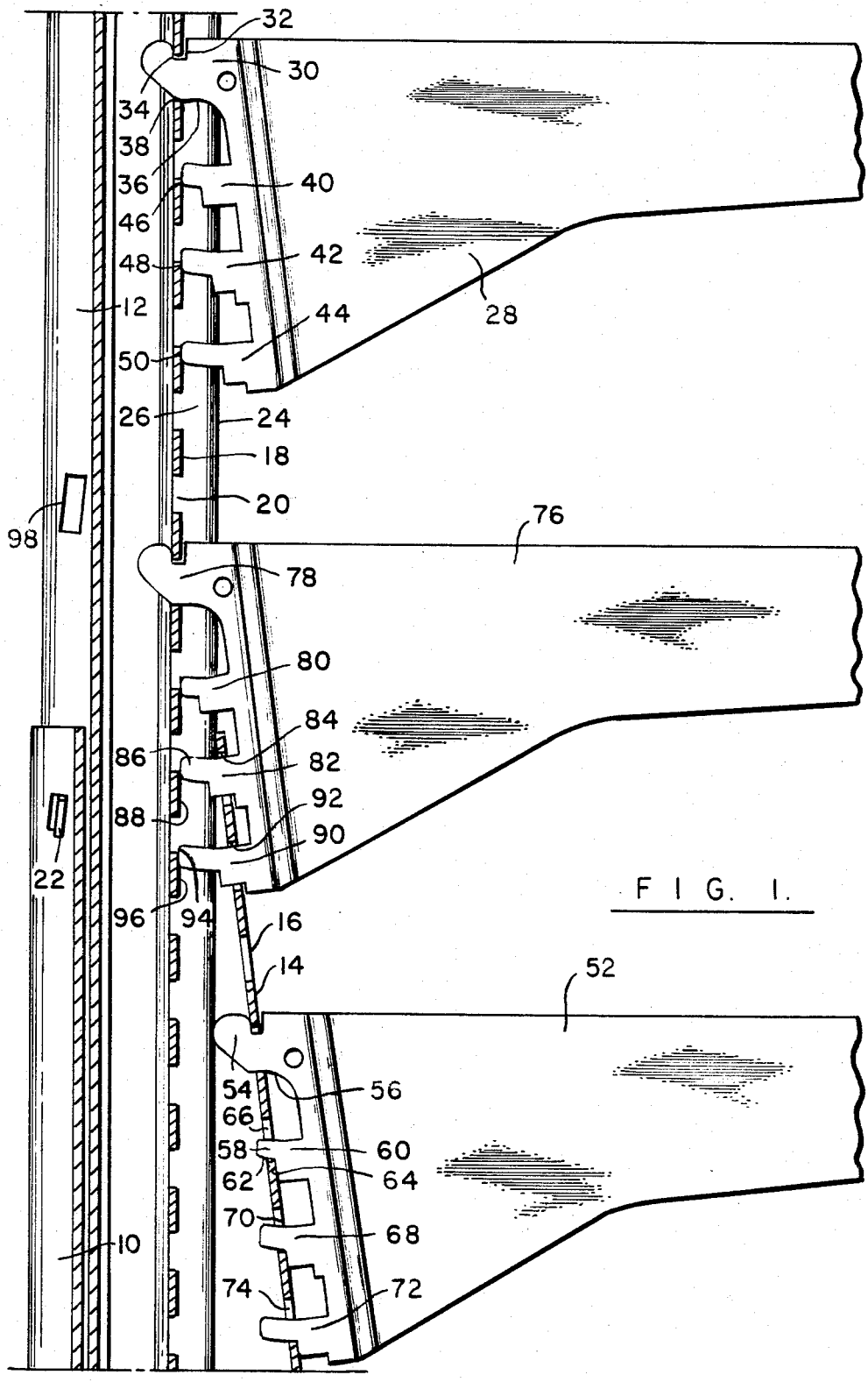
FIG. 1 is a fragmentary vertical section through a shelf support in accordance with the invention, showing a first shelf bracket on a vertical part of the support, a second shelf bracket spanning the transition between the vertical part and a sloping lower part, and a third shelf bracket mounted entirely on the sloping lower part of the support.
Figure 2:
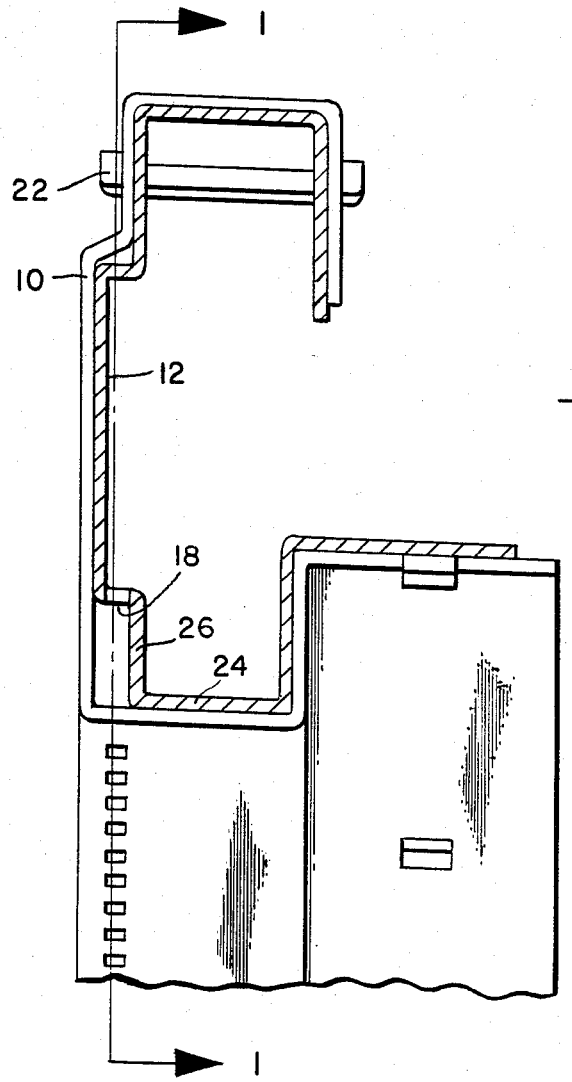
FIG. 2 is a horizontal section through the upper part of the shelf support of FIG. 1, as viewed from above, with the shelf brackets removed.

A left-hand upright is shown in FIGS. 1 and 2 (the right-hand upright being a mirror image thereof). The upright comprises a lower part 10, and an upper part 12 which fits into the lower part in telescoping relationship. Lower part 10 has a sloping face provided by a sheet 14. This face has a series of vertically elongated rectangular slots extending in the vertical direction downwardly from a location adjacent to its upper end. One such slot is indicated in FIG. 1 at 16. These slots extend from the front surface to the rear surface of sheet 14. Upper part 12 of the support has a similar sheet 18 having a vertically extending series of similarly shaped slots, one of which is indicated at 20. The slots in the upper part are spaced at closer intervals than the slots in the lower part.

The upper and lower parts of the support are secured together by a key 22 which extends through rectangular holes in the respective members. The sides of the rectangular holes are oblique, and cooperate with key 22 in such a way that the weight of the upper support produces a force urging it rearwardly against the rear wall of the lower part. The front wall 24 of the upper part extends downwardly into the lower part just behind the upper edge of sheet 14. However, sheet 18 is recessed behind sheet 24, sheets 18 and 24 being connected by a sheet 26. Sheet 18 is recessed by a distance sufficient to allow a shelf bracket to be mounted on the lower support with the uppermost tab of the bracket in the uppermost slot in the lower support without interference between the tab and sheet 18.

Shelf bracket 28 has an upper tab 30 with a notch 32. Forwardly facing surface 34 of notch 32 engages the rear face of sheet 18 when tab 30 extends through a slot in sheet 18. Surface 36 on the underside of tab 30 rests on the lower edge 38 of a slot to provide vertical support for the shelf bracket. The shelf bracket also has lower tabs 40, 42 and 44 with ends 46, 48 and 50 respectively. These ends engage the front face of sheet 18, thereby holding the bracket, and its associated shelf surface, horizontal.

A similar shelf bracket 52 is shown engaged with sloping sheet 14 of the lower support. Upper tab 54 is engaged in the uppermost of four successive slots, and its lower edge 56 rests on the lower edge of the slot in which it is engaged. Projection 58 of tab 60 has a rearwardly extending, downwardly facing surface 62 which engages the lower edge of slot 66, as part 58 extends into slot 66. Rearwardly facing edge 64 of tab 60 engages the front face of sheet 14 just below the lower edge of slot 66. Tab 68 is similarly engaged with slot 70, and tab 72 is similarly engaged with slot 74.

The brackets are engaged with the supports by first tilting them rearwardly, and causing their upper tabs to engage the appropriate slots in the supports. The brackets are then tilted downwardly, and automatically stop when they reach the horizontal position. Bracket 28 stops by reason of engagement of the ends of its three lower tabs with the front face of sheet 18. Bracket 52 stops tilting when the surfaces of its lower tabs corresponding to surface 64 on tab 60 engage the front face of sheet 14.

Shelf bracket 76 is positioned so that its two upper tabs 78 and 80 are located above the transition between the vertical upper part and the sloping lower part of the support whereas its lower tabs 82 and 90 are located below the transition.

Bracket 76 is engaged with the vertical part of the support in the same manner as is bracket 26. That is, the ends of the lower three tabs 80, 82 and 90 engage the front face of sheet 18. Tab 82, however, extends through slot 84 in sheet 14, and tab 90 extends through slot 92 in sheet 14. Tabs 82 and 90 may, but need not, contact any part of sheet 14. Preferably, there is no such contact. Tab 82 merely extends through slot 84, and its rear end 86 engages part 88 of sheet 18. Similarly, tab 90 extends through slot 92, and its rear end 94 engages part 96 of sheet 18.

Bracket 76 is installed in the same way as are brackets 28 and 52, by initially engaging its uppermost tab 78 with a slot, and then tilting the bracket downwardly until its lower three tabs engage the face of sheet 18, whereupon the supporting surface of the shelf assumes a horizontal position.

Rectangular opening 98 is provided for the purpose of reducing the height of the shelving unit. Key 22 may be temporarily removed from the position shown in FIG. 1 allowing upper support part 12 to be lowered into lower support part 10 until opening 98 is aligned with the corresponding opening in part 10. Then the key may be reinserted. The positions of the rectangular holes relative to the slots must be carefully controlled in manufacture of the shelving units so that the slots of the upper and lower parts of the supports are in the proper relative positions when the support parts are locked together.

Figure 3:
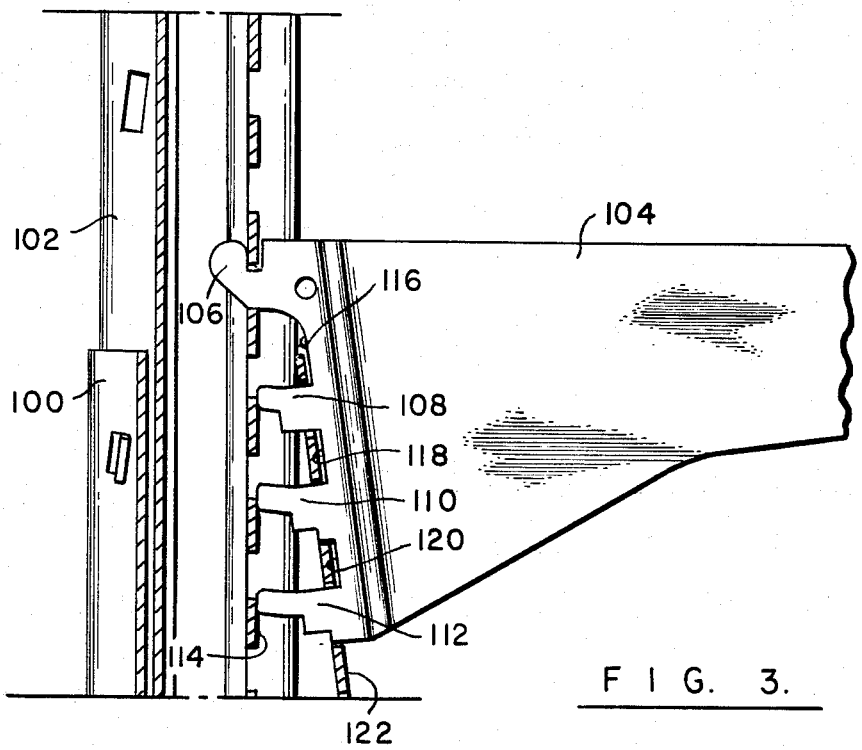
FIG. 3 is a fragmentary vertical section of a support, showing a shelf bracket spanning the transition at a height different from the height of the second shelf bracket of FIG. 1.

In FIG. 3, the upright comprises a lower part 100 having a sloping, slotted front face and an upper part 102 having a vertical, slotted front face. Bracket 104 has its uppermost tab 106 located above the transition, and has its lower tabs 108, 100 and 112 below the transition. Again, all three lower tabs engage the front face of sheet 114. The lower three tabs are sufficiently long that a clearance is provided between the front face of sloping sheet 122 and edges 116, 118 and 120 between the tabs.

Figure 4:
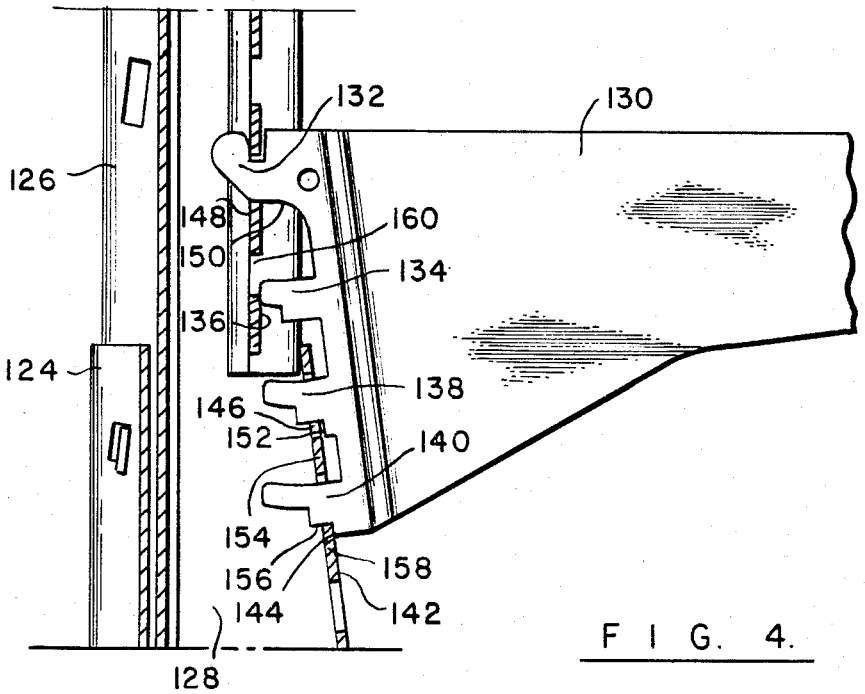
FIG. 4 is a fragmentary vertical section through a modified version of the support, wherein the lowermost tabs of a shelf bracket spanning the transition are engaged with the sloping support rather than with the hidden part of the face of the vertical support.

The upright in FIG. 4 comprises a lower part 124 having a sloping, slotted front face, and an upper part 126 having a vertical, slotted front face. The front of upper part 126 is cut away at 128 to eliminate unnecessary weight. Bracket 130 has an upper tab 132, and an intermediate tab 134 engaged with the face of vertical sheet 136 in the usual manner. Lower tabs 138 and 140, however, are not engaged with the face of vertical sheet 136. Support against downward tilting of the shelf bracket is provided by engagement of the end of tab 134 with the face of sheet 136 and by engagement of step 144 on tab 140 with the face of sheet 142. The corresponding step on tab 138 may also engage the face of sheet 142. However, as shown in FIG. 4, the uppermost slot 146 of the sloping part may be slightly longer than the other slots. The additional length of slot 146 may be necessary, for example in the case where an existing support such as described in my pending application is modified for use with shelf brackets of the present invention. Lengthening slot 146 is the simplest way to make the necessary modification to the support.

Vertical support for the bracket is provided by engagement of surface 150 of tab 132 with part 148 of sheet 136, and also by the engagement of edge 156 of tab 140 with part 158 of sheet 142. Step 152 of tab 138 does not engage part 154 of sheet 142 because the uppermost opening of sheet 142 is larger than the other openings.

Bracket 130 can also be installed with its upper tab engaged with slot 160, and with its lower three tabs engaged with the uppermost three slots in the sloping part of the support.

The invention provides a simple and effective means for utilizing shelf positions which were not heretofore available on two-part shelf supports having relative adjustability between the upper and lower parts. The invention is applicable to shelf supports with vertical upper parts and sloping lower parts regardless of whether or not the slots in the upper part are recessed behind the upper end of the lower part. The invention is also applicable to shelf supports having upper and lower parts which are both vertical where the slots in the upper part are recessed behind the upper end of the lower part.

Various modifications can be made to the invention, particularly in the number and arrangement of shelf tabs, without departing from the scope of the invention as defined in the following claims.

I claim:

1. A system of shelving wherein identical shelves may be mounted interchangeably on the upper and lower parts of two-part, telescoping slotted supporting members in which the slotted surface of one of the telescoping members is recessed relative to the slotted surface of the other member, said system comprising:

a first support having a surface with a vertically extending series of slots and having an upper end;

a second support having a surface with a vertically extending series of slots and extending upwardly from the upper end of the first support; and a shelf having a supporting surface and at least one shelf bracket, the shelf bracket having upper and lower tabs;

the series of slots in the slotted surface of the first support extending to a location adjacent to the upper end of said first support whereby said shelf can be mounted with its upper tab in engagement with a slot in the second support and its lower tab extending into a slot in the lower support;

the slotted surface of the second support being recessed behind the slotted surface of the first support by a distance such that, when the shelf is mounted at any position on the first support with its tabs extending through slots in said first support, the recess provides clearance for said tabs;

and having means for causing the supporting surface to be situated in the same relationship to the horizontal when the shelf is mounted with both tabs engaged with the second support, and when the shelf is mounted with its upper tab engaged with a slot in the second support and its lower tab extending into a slot in the first support.

2. A system of shelving wherein identical shelves may be mounted interchangeably on the upper and lower parts of two-part, telescoping slotted supporting members in which the slotted surface of one of the telescoping members is recessed relative to the slotted surface of the other member, said system comprising:

a first support having a first planar sheet with front and rear surfaces, said sheet having an upper end, and having a first series of slots in the sheet extending in the vertical direction downwardly from a location adjacent to said upper end;

a second support having a second planar sheet with front and rear surfaces, and having a second series of slots in the second sheet extending in the vertical direction upwardly from a location adjacent to said upper end of the first sheet, and the second sheet extending downwardly behind the rear surface of the first sheet to a location substantially below the level of the upper end of the first sheet;

and a shelf having an article-supporting surface and at least one shelf bracket, the shelf bracket having an upper tab with a forwardly facing surface, the upper tab being of a size such that it can enter a slot in the first or second series, and the forwardly facing surface being adapted to engage the rear surface of the first or second planar sheet to prevent forward movement of the upper tab with respect to the planar sheet in which it is engaged, and the shelf bracket also having a lower tab, the lower tab having a rearwardly facing surface positioned with respect to the upper tab so that it engages the front surface of the second planar sheet while the forwardly facing surface of the upper tab is engaged with the rear surface of the second planar sheet;

the second planar sheet being recessed behind the first planar sheet by a distance such that, when the shelf is mounted at any position on the first support, with its tabs extending through slots in said first series, the recess provides clearance for said tabs;

and having means for connecting the second support to the first support at a height such that, with the upper tab engaged in a slot in the second support near the upper end of the first support so that the lower tab is below the upper end of the first support, the lower tab extends through a slot in the first support with its rearwardly facing surface in engagement with the front surface of the second planar sheet, whereby the article supporting surface is in the same angular relationship to the horizontal when the shelf is mounted entirely on the second support as when the shelf is mounted with its upper tab in engagement with the second support and its lower tab extending into a slot in the first support.

3. A system of shelving according to claim 2 in which the means for connecting is capable of connecting the second support to the first support at at least two alternative heights at each of which the second support extends upwardly from the first support to a different extent, and in each of which, with the upper tab engaged in a slot in the second support near the upper end of the first support so that the lower tab is below the upper end of the first support, the lower tab extends through a slot in the first support with its rearwardly facing surface in engagement with the front surface of the second planar sheet.

4. A system of shelving according to claim 3 in which the series of slots in the second planar sheet of the second support also extends below the upper end of the first sheet of the first support when the first and second supports are in at least one of said relationships.

5. A system of shelving wherein identical shelves may be mounted interchangeably on supporting members having surfaces disposed at different angles relative to the horizontal, said system comprising:

a first support having a first planar sheet with front and rear surfaces, the first sheet being disposed at a first angle with respect to the horizontal, having an upper end, and having a first series of slots in the sheet extending in the vertical direction downwardly from a location adjacent to said upper end;

a second support having a second planar sheet with front and rear surfaces, the second sheet being disposed at a second angle with respect to the horizontal, the second angle being more nearly vertical than the first angle, and having a second series of slots in the second sheet extending in the vertical direction upwardly from a location adjacent to said upper end of the first sheet, the spacing of the slots in the first series being greater than the spacing of the slots in the second series, and the second sheet extending downwardly behind the rear surface of the first sheet to a location substantially below the level of the upper end of the first support;

and a shelf having an article-supporting surface and at least one shelf bracket, the shelf bracket having an upper tab with a forwardly facing surface, the upper tab being of a size such that it can enter a slot in the first or second series, and the forwardly facing surface being adapted to engage the rear surface of the first or second planar sheet to prevent forward movement of the upper tab with respect to the planar sheet in which it is engaged, and the shelf bracket also having a lower tab, the lower tab having a first rearwardly facing surface positioned with respect to the upper tab so that it engages the front surface of the second planar sheet while the forwardly facing surface of the upper tab is engaged with the rear surface of the second planar sheet, the lower tab having a second rearwardly facing surface positioned with respect to the upper tab so that it engages the front surface of the first planar sheet while the forwardly facing surface of the upper tab is engaged with the rear surface of the first planar sheet;

the first and second rearwardly facing surfaces on the lower tab being so related to each other and to said first and second angles that the article supporting surface is in the same angular relationship to the horizontal when the shelf is engaged with the first support as it is when the shelf is engaged with the second support;

the second planar sheet being recessed behind the first planar sheet by a distance such that, when the shelf is mounted at any position on the first support, with its tabs extending through slots in said first series, the recess provides clearance for said tabs;

and having means for connecting the second support to the first support at a height such that, with the upper tab engaged in a slot in the second support near the upper end of the first support so that the lower tab is below the upper end of the first support, the lower tab extends through a slot in the first support with its first rearwardly facing surface in engagement with the front surface of the second planar sheet, whereby the article supporting surface is also in said same angular relationship to the horizontal when the shelf is mounted with its upper tab in engagement with the second support and its lower tab extending into a slot in the first support.

6. A system of shelving according to claim 5 in which the means for connecting is capable of connecting the second support to the first support at at least two alternative heights at each of which the second support extends upwardly from the first support to a different extent, and in each of which, with the upper tab engaged in a slot in the second support near the upper end of the first support so that the lower tab is below the upper end of the first support, the lower tab extends through a slot in the first support with its first rearwardly facing surface in engagement with the front surface of the second planar sheet.

7. A system of shelving according to claim 6 in which the series of slots in the second planar sheet of the second support also extends below the upper end of the first sheet of the first support when the first and second supports are in at least one of said relationships.

8. A system of shelving wherein identical shelves may be mounted interchangeably on the upper and lower parts of two-part, telescoping slotted supporting members in which the slotted surface of one of the telescoping members is disposed in non-parallel relationship and recessed relative to the slotted surface of the other member, said system comprising:

a first support having a surface with a vertically extending series of slots and having an upper end;

a second support having a surface with a vertically extending series of slots and extending upwardly from the upper end of the first support, the slotted surface of the first support being disposed in non-parallel relationship to the slotted surface of the second support;

a shelf having a supporting surface and at least one shelf bracket, the shelf bracket having upper and lower tabs;

the series of slots in the slotted surface of the first support extending to a location adjacent to the upper end of said first support whereby said shelf can be mounted with its upper tab in engagement with a slot in the second support and its lower tab extending into a slot in the lower support;

the slotted surface of the second support being recessed behind the slotted surface of the first support by a distance such that, when the shelf is mounted at any position on the first support with its tabs extending throught slots in said first support, the recess provides clearance for said tabs;

and having means for causing the supporting surface to be situated in the same relationship to the horizontal when the shelf is mounted with both tabs engaged with the second support, when the shelf is mounted with both tabs engaged with slots in the first support and when the shelf is mounted with its upper tab engaged with a slot in the second support and its lower tab extending into a slot in the first support.

* * * * *